US007213351B2

(12) United States Patent
Polegato Moretti et al.

(10) Patent No.: US 7,213,351 B2
(45) Date of Patent: May 8, 2007

(54) WATERPROOFED AND BREATHABLE SOLE FOR SHOES AND MANUFACTURING METHOD THEREOF

(75) Inventors: Mario Polegato Moretti, Crocetta Del Montello (IT); Antonio Ferrarese, Isola Della Scala (IT)

(73) Assignee: Geox S.p.A., Montebelluna (IT)

( * ) Notice: Subject to any disclaimer, the term of this patent is extended or adjusted under 35 U.S.C. 154(b) by 77 days.

(21) Appl. No.: 10/531,439

(22) PCT Filed: Oct. 13, 2003

(86) PCT No.: PCT/EP03/11307

§ 371 (c)(1),
(2), (4) Date: Apr. 14, 2005

(87) PCT Pub. No.: WO2004/034830

PCT Pub. Date: Apr. 29, 2004

(65) Prior Publication Data

US 2005/0268486 A1 Dec. 8, 2005

(30) Foreign Application Priority Data

Oct. 15, 2002 (IT) ..... PD2002A0264

(51) Int. Cl.
*A43B 13/14* (2006.01)

(52) U.S. Cl. ..... 36/14; 36/25 R; 12/146 B; 12/142 R

(58) Field of Classification Search ..... 36/14, 36/12, 25 R; 12/146 B, 142 R
See application file for complete search history.

(56) References Cited

U.S. PATENT DOCUMENTS

| | | | | |
|---|---|---|---|---|
| 5,022,096 | A * | 6/1991 | Pacanowsky | 2/227 |
| 5,598,644 | A * | 2/1997 | Polegato | 36/3 B |
| 6,035,555 | A * | 3/2000 | Pavelescu et al. | 36/14 |
| 6,655,048 | B2 | 12/2003 | Moretti | |
| 6,681,500 | B2 | 1/2004 | Moretti | |
| 6,851,205 | B2 * | 2/2005 | Chen et al. | 36/55 |
| 6,874,251 | B2 | 4/2005 | Moretti | |
| 7,127,833 | B2 * | 10/2006 | Haimerl | 36/14 |
| 2001/0010127 | A1 * | 8/2001 | Polegato Moretti | 36/3 B |
| 2001/0023023 | A1 | 9/2001 | Morlacchi | |
| 2004/0035022 | A1 | 2/2004 | Polegato Moretti | |
| 2004/0045189 | A1 | 3/2004 | Polegato Moretti | |

FOREIGN PATENT DOCUMENTS

| | | |
|---|---|---|
| EP | 1 031 656 | 8/2002 |
| WO | 02/052970 | 7/2002 |

* cited by examiner

*Primary Examiner*—Ted Kavanaugh
(74) *Attorney, Agent, or Firm*—Oblon, Spivak, McClelland, Maier & Neustadt, P.C.

(57) ABSTRACT

A waterproofed and breathable sole (10) for shoes, characterized in that it comprises a tread (11) made of leather or similar breathable and water-permeable material, which is coverad at least partially in an upward region by a membrane (12) made of a material that is breathable and waterproof and is joined perimetrically to the tread (11) by means of a screen-printed sealing ring (14).

20 Claims, 1 Drawing Sheet

WATERPROOFED AND BREATHABLE SOLE FOR SHOES AND MANUFACTURING METHOD THEREOF

TECHNICAL FIELD

The present invention relates to an improved waterproofed and breathable sole for shoes and to the method for manufacturing it.

BACKGROUND ART

It is known that the main problem observed in using shoes with an ordinary sole made of natural material such as leather or equivalents is constituted by wet walking areas.

When rain and bad weather make streets wet and slippery, it is in fact not advisable to use shoes with leather soles, since leather, just because it is breathable and healthy for the foot, is not waterproof but in fact absorbs water.

The thinner the leather, the higher the rate at which it becomes impregnated with water or moisture, ultimately wetting the user's foot.

Accordingly, the use of soles with a leather tread is constrained by weather conditions, and for this reason shoes made of this type of material are mainly provided by manufacturers in the summer collections in countries where the dry season is more substantial.

A sole (disclosed in U.S. Pat. No. 5,598,644 and EP 0 619 959) has been devised which comprises a tread made of leather or similar material that is at least partially covered in an upward region by a membrane made of a material that is vapor-permeable and waterproof.

The waterproof and breathable membrane is fixed to the sole by means of adhesive arranged in spots, and a perimetric sealing ring made of polymeric material, for example polyurethane, is injected in a mold to assemble all the parts.

Although this sole is a considerable technical step forward, in that it renders the leather tread waterproof, it has in any case shown some limitations.

A first limitation arises from the very nature of leather, which as mentioned is a breathable material, but its breathability is not so high as to dissipate in a short time all the heat and vapor that form inside the shoe during use.

A second limitation is due to the fact that as mentioned the seal is produced by injection-molding a ring of plastic material.

This process requires the provision of thick seals and accordingly increases the rigidity of the sole, so that some types of shoe in which high flexibility is required, such as women's shoes, are difficult to manufacture.

The high cost of this technology (provision of an aluminum mold for each shoe model and size to be produced) is not inconsequential.

An attempt has been made to obviate the problem of thicknesses by using, for the perimetric seal, films made of thermoplastic polyurethane material with a thickness of 200 microns.

Although this method allows to obtain qualitatively acceptable products, it is extremely expensive, since it is almost entirely manual.

DISCLOSURE OF THE INVENTION

The aim of the present invention is to provide a sole, and the method for manufacturing it, that solve the drawbacks noted above in known types of waterproofed breathable shoes with a tread made of leather or equivalent material.

A consequent primary object is to provide a sole that can be thin and flexible.

Another object is to increase breathability.

Another important object is to provide a sole that is characterized by the possibility of high flexibility in production.

Another object is to increase user comfort.

Another object is to provide a sole that can be manufactured at low cost and therefore can be sold at a competitive price.

Another object is to provide a sole that can be manufactured with known equipment and methods.

This aim and these and other objects that will become better apparent hereinafter are achieved by a waterproofed breathable sole for shoes, characterized in that it comprises a tread made of leather or similar breathable and water-permeable material, which is covered at least partially in an upward region by a membrane made of a material that is breathable and waterproof and is joined perimetrically to the tread by means of a screen-printed sealing ring.

BRIEF DESCRIPTION OF THE DRAWINGS

Further characteristics and advantages of the invention will become better apparent from the detailed description of some embodiments thereof, illustrated by way of non-limitative example in the accompanying drawings, wherein.

WAYS TO CARRYING OUT THE INVENTION

Figure 1:
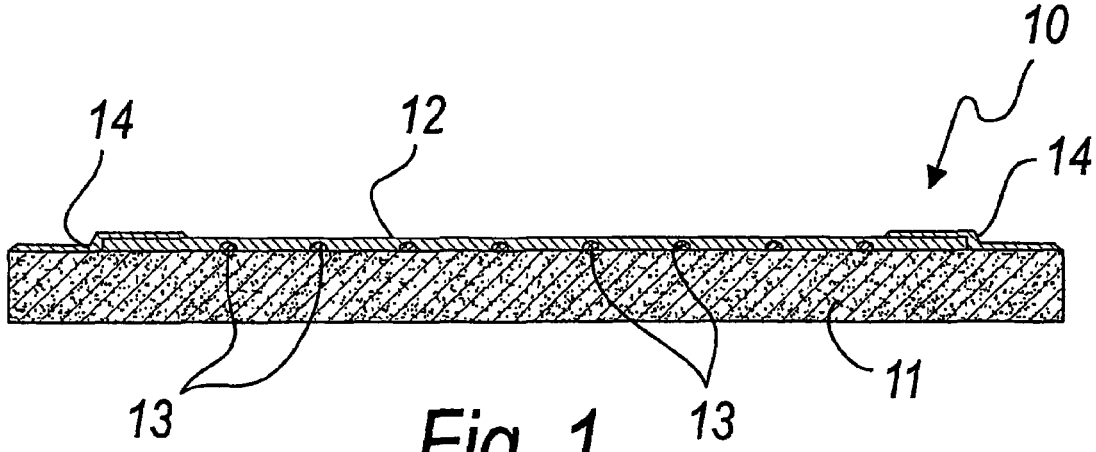
FIG. 1 is a schematic sectional view of the sole according to the invention.

With reference to FIG. 1 cited above, an improved waterproofed and breathable sole for shoes is generally designated by the reference numeral 10 and comprises a tread 11 made of leather or similar breathable and water-permeable material (such as leather, open-cell synthetic material, et cetera), covered in an upward region by a membrane 12 that is impermeable to water and vapor-permeable (breathable) and is preferably made of expanded polytetrafluoroethylene (PTFE).

The membrane 12, which in this case has no support of any kind, is provided in thicknesses that can vary between 5 and 40 microns.

The membrane 12 is conveniently spaced perimetrically from the edge of the tread 11.

The membrane 12 is preferably fixed to the tread 11 by means of adhesive 13 in spots and a perimetric sealing ring 14 is provided by screen printing.

The process for manufacturing the ring 14 provides for a first step for preparing a frame 15, which is constituted by a fabric with a sufficiently wide mesh (12 to 43 threads per centimeter), such as to allow the passage of a solution or dispersion of polymer, in a preferred embodiment polyurethane, which has a dry residue of approximately or substantially at least 60%.

This solution or dispersion is per se known and commercially available.

This material, in order to allow greater resistance to temperatures of at least 50–60° C. and ensure its chemical and structural integrity (in particular its resistance to hydrolysis and aging stability), receives the addition of suitable cross-linking agents, i.e., agents that facilitate the cross-linking reaction and are therefore capable of reacting with the functional groups that are still free inside the polyurethane.

These agents can be, for example, isocyanates (3–5%) suitably catalyzed to increase their reactivity, for example by means of amines.

During this preparatory step, it is also possible to cover some regions of the frame by way of a photoengraving process, in the regions that must not be covered by the solution, for example the ones subsequently affected or covered by the membrane 12, naturally with the exception of the regions that correspond to its perimetric regions or edges.

The membrane 12, already treated with spots 13 of glue, is then bonded to the tread 11 by hot pressing by means of a hot press (not shown in the figures).

Figure 2:
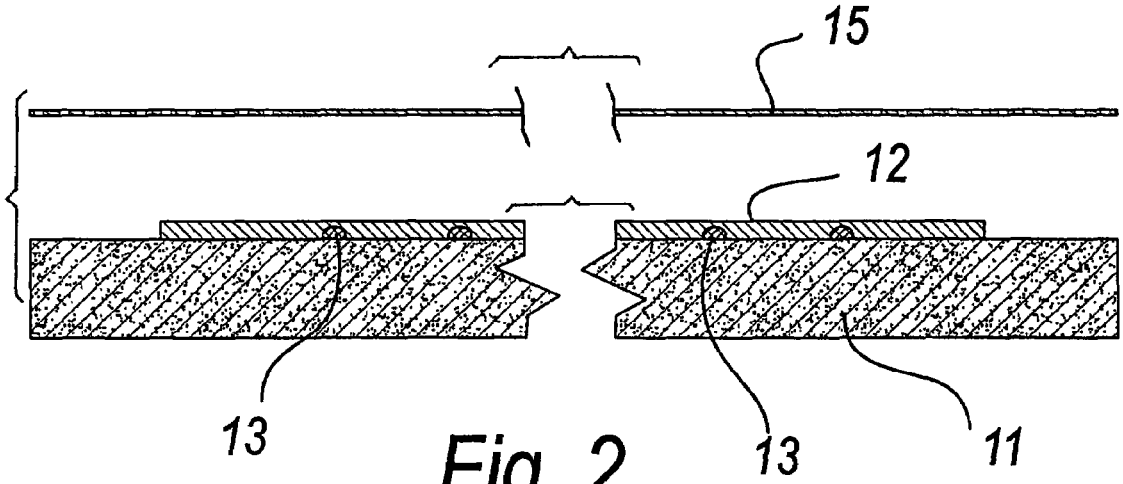
FIG. 2 is a schematic sectional view illustrating a step of the process for manufacturing the sole of FIG. 1.
Figure 3:
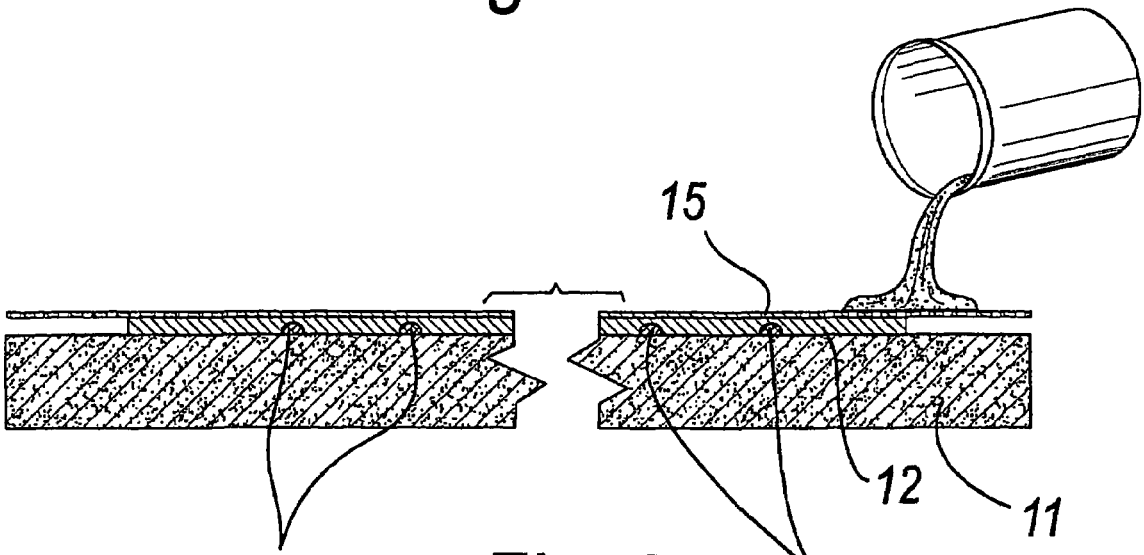
FIG. 3 is a schematic sectional view illustrating a step of the manufacturing process that follows the step of FIG. 2.

The next steps (FIG. 2) are to arrange the tread 11 under the frame 15 and pour (FIG. 3) said solution or dispersion of polymer onto said frame 15.

Penetration of the material through the mesh of the frame 15 is facilitated by using a doctor.

The material, which is in the fluid state, due to the evaporation of the solvent phase, leaves the solid phase contained therein deposited on the tread 11 and on the membrane 12, forming the sealing ring 14.

The assembly constituted by the tread 11, the membrane 12 and the sealing ring 14, which corresponds to FIG. 1, is removed and dried.

After forming the ring 14, it is possible to perform a further heating step, substantially at 60–80° C., in order to accelerate cross-linking.

This heating step can be alternative to, or combined with, said step for addition of isocyanate (an agent that facilitates cross-linking).

With this technology it is possible to obtain films of a chosen constant and reproducible thickness (on the order of 100–500 microns).

The amount of fluid deposited is changed by varying the number of threads per centimeter of the frame 15.

It is possible to provide in alternative embodiments of the invention the prior application to the tread 11 of adhesion promoters, again constituted by dispersions or solutions of polyurethane polymers, which however have a low viscosity (less than 600 centipoises, according to the Brooksfield method), i.e., are capable of penetrating through the fibers of the leather itself.

In still other alternative embodiments, it is possible to use polyurethanes in a solution or dispersion having a low relative molecular mass.

In this case it is also convenient to provide an addition of a cross-linking agent such as catalyzed isocyanate, in order to block the reversibility of the process due to the temperature.

Another embodiment can comprise the application of multiple layers of polymer dispersion in order to ensure the continuity of the film that forms the ring 14.

In practice it has been found that the intended aim and objects of the present invention have been achieved.

The sole has the qualitative characteristics of leather soles, particularly breathability, together with the qualitative characteristics of soles made of rubber or synthetic material, particularly waterproofness, and all this is achieved with reduced thicknesses by virtue of the provision of the perimetric seal by screen printing.

Although the principle of screen printing is per se known, it is generally exclusively used to provide decorative details on items of clothing and shoes.

Practical tests have demonstrated that the method, suitably adapted as described above, can be used conveniently as a means for providing a perimetric seal of very low thickness between the membrane 12 and the tread 11.

The sole 10 can therefore be provided in a thin and flexible form and can be used for any shoe design, and also for women's shoes.

It should be noted that said sole can be manufactured without particular difficulties with a manufacturing process that is functionally more flexible than the current one.

The invention thus conceived is susceptible of numerous modifications and variations, all of which are within the scope of the appended claims.

All the details may further be replaced with other technically equivalent elements.

In practice, the materials used, so long as they are compatible with the contingent use, as well as the dimensions, may be any according to requirements.

The disclosures in Italian Patent Application No. PD2002A000264 from which this application claims priority are incorporated herein by reference.

The invention claimed is:

1. A waterproofed breathable sole for shoes, comprising a tread made of leather or similar breathable and water-permeable material, which is covered at least partially in an upward region by a membrane made of a material that is breathable and waterproof and is joined perimetrically to the tread by way of a screen-printed sealing ring made of a solution or dispersion of polymer that has a dry residue of at least 60% by weight with the addition of setting agents.

2. The sole according to claim 1, wherein said waterproof and vapor-permeable membrane is made of expanded polytetrafluoroethylene.

3. The sole according to claim 1, wherein said waterproof and vapor-permeable membrane is supportless, and is provided with thicknesses between 5 and 40 microns.

4. The sole according to claim 1, wherein said membrane is spaced perimetrically from the edge of said tread.

5. The sole according to claim 1, wherein said membrane is fixed to said tread by way of adhesive applied in spots.

6. A method for manufacturing a sole as set forth in claim 1, comprising:

preparing a frame that comprises, at least at perimetric regions of the membrane for the sole that are located in selected position on the tread, a fabric with a mesh that is sufficiently wide to allow the passage of a solution or dispersion of polymer that has a dry residue of at least 60% by weight with the addition of setting agents;

arranging said membrane on said tread;

placing said tread and said membrane under said frame, pouring said solution or dispersion of polymer onto said frame, and making it penetrate through the mesh of said frame, forming at least one layer of a sealing ring;

removing the assembly constituted by the tread, the membrane and the ring; and drying the assembly.

7. The method according to claim 6, comprising, prior to the arrangement of said membrane on said frame, covering by a photoengraving technique the regions of said frame that are to be left uncovered by said solution or dispersion of polymer.

8. The method according to claim 7, wherein said regions covered by photoengraving are the regions subsequently covered by said membrane, except for the regions that correspond to its edges.

9. The method according to claim 7, wherein the step of arrangement of said membrane on said tread also comprises the gluing of said membrane, treated beforehand with spots of glue, to said tread.

10. The method according to claim 9, wherein said gluing is performed by way of hot pressing.

11. The method according to claim 7, wherein said solution or dispersion of polymer that has a dry residue of approximately 60% by weight is a polyurethane solution or dispersion.

12. The method according to claim 11, comprising addition to said solution or dispersion of polyurethane polymer that has a dry residue of approximately 60% by weight of cross-linking agents.

13. The method according to claim 12, wherein said cross-linking agents are catalyzed isocyanates.

14. The method according to claim 6, comprising a heating step, after the forming of said ring, in order to accelerate the cross-linking of said solution or dispersion of polymer.

15. The method according to claim 14, wherein said heating is performed substantially at 60–80° C.

16. The method according to claim 6, comprising a preliminary application, to said tread, of adhesion promoters constituted by dispersions or solutions of polyurethane polymers having a low viscosity, such as to be capable of penetrating through the fibers of said leather.

17. The method according to claim 6, consisting of the preliminary application, to said tread, of polyurethanes having a low relative molecular mass in a solution or dispersion.

18. The method according to claim 17, comprising addition to said polyurethanes, having a low relative molecular mass in solution or dispersion, of cross-linking agents.

19. The method according to claim 18, wherein said cross-linking agents are catalyzed isocyanates.

20. The method according to claim 6, comprising facilitation of the penetration of said solution or dispersion of polymer through the mesh of said frame through action of a doctor.

* * * * *